US008511523B2

(12) United States Patent
Joosten et al.

(10) Patent No.: US 8,511,523 B2
(45) Date of Patent: Aug. 20, 2013

(54) AID FOR PUTTING ON ELASTIC STOCKINGS

(75) Inventors: Erik Theodorus Johannus Joosten, Geleen (NL); Carl Johannus Theodorus Joosten, Meers-Stein (NL)

(73) Assignee: Arion Holding B.V., Geleen (NL)

( * ) Notice: Subject to any disclaimer, the term of this patent is extended or adjusted under 35 U.S.C. 154(b) by 0 days.

(21) Appl. No.: 13/353,521

(22) Filed: Jan. 19, 2012

(65) Prior Publication Data

US 2012/0187159 A1 Jul. 26, 2012

(30) Foreign Application Priority Data

Jan. 20, 2011 (NL) ..... 2006039

(51) Int. Cl.
*A47G 25/80* (2006.01)

(52) U.S. Cl.
USPC ..... 223/111; 223/112

(58) Field of Classification Search
USPC ..... 223/111–114, 118
See application file for complete search history.

(56) References Cited

U.S. PATENT DOCUMENTS

| | | | | |
|---|---|---|---|---|
| 4,249,267 | A * | 2/1981 | Voss | 2/69 |
| 5,673,826 | A | 10/1997 | Stolk | |
| 6,032,839 | A * | 3/2000 | Joosten et al. | 223/112 |
| 6,052,828 | A * | 4/2000 | Widdemer | 2/161.2 |
| 8,042,716 | B2 * | 10/2011 | Lun | 223/111 |
| 2004/0178234 | A1 * | 9/2004 | Sawlewicz | 223/111 |
| 2007/0119882 | A1 * | 5/2007 | Scott | 223/111 |
| 2008/0277431 | A1 | 11/2008 | Lun | |
| 2009/0242594 | A1 * | 10/2009 | Van Den Berge et al. | 223/111 |
| 2010/0192278 | A1 * | 8/2010 | Powell | 2/160 |
| 2011/0083254 | A1 * | 4/2011 | Trutna et al. | 2/326 |

FOREIGN PATENT DOCUMENTS

| | | | |
|---|---|---|---|
| EP | 0681442 | A1 | 11/1995 |
| EP | 1790258 | A1 | 5/2007 |
| WO | 9502980 | | 2/1995 |
| WO | 2005099529 | A1 | 10/2005 |

* cited by examiner

*Primary Examiner* — Nathan Durham

(74) *Attorney, Agent, or Firm* — The Webb Law Firm, P.C.

(57) ABSTRACT

The invention relates to an aid for putting on an elastic stocking in particular. The aid comprises a substantially flat and flexible sheet body manufactured from a smooth material, which is provided with removal means to remove the aid from between a foot and a stocking arranged around it, and with connecting means arranged on opposite edges of the body, which when in use interact to interconnect the opposite edges, resulting in a tube-like body having a insertion side for the foot and an opposite foot section, whereby each connecting means comprises magnets which are attracted by corresponding magnets in the other connecting means. The aid is simpler and more convenient in use than the known aid.

12 Claims, 4 Drawing Sheets

AID FOR PUTTING ON ELASTIC STOCKINGS

BACKGROUND OF THE INVENTION

1 Field of the Invention

The invention relates to an aid for putting on elastic stockings. Although the aid has been developed particularly for putting on elastic stockings, the invention also relates to an aid for putting on prostheses, liners for prostheses, sport protection means, socks, shoes, skiing shoes, riding boots and wetsuits.

2 Discussion of the Prior Art

An elastic stocking or support stocking is applied as a medical aid, among others for the treatment of varicose. For this purpose the elastic stocking needs to be wrapped so tightly around the leg of a user that it exerts a relatively large tensioning force on the leg. Due to the desirably large tensioning force the user encounters problems during putting on the stocking. The user needs to bring the stocking in a ready to use state, subsequently put his foot into the insertion opening of the stocking, and thereafter pull the stocking along the foot and leg. In order to have the stocking wrapped tightly around the leg, the user has to tighten the stocking, which requires a considerable amount of strength since the stocking has to be pulled along the heel of the foot and over the leg, whereby the user experiences a fair amount of friction. Here the friction is also caused by the fact that the diameter of the stocking is smaller than the circumference of the ankle.

A put-on aid for elastic stockings is known from EP 0681442B1. After use this aid is removed from under the stocking through the opening of the stocking directed to the knee. This known aid has a complicated construction, and in addition is rather complex when in use.

Although the removal of the known aid occurs relatively well, it is susceptible to improvements. It has to be realised however that users of elastic stockings usually are in years and thus are lacking the strength to pull the aid away from between the leg and the stocking.

The object of the present invention among others is to provide an aid for putting on elastic stockings which may be removed with even less strength and in addition is suited for use with elastic stockings of which the toe end is closed. The aid is also suited for use with elastic stockings of which the toe end is open.

SUMMARY OF THE INVENTION

In a first aspect the aid for putting on (in particular) an elastic stocking comprises a substantially flat and flexible sheet body manufactured from a smooth material, which is provided with removal means to remove the aid from between a foot and a stocking wrapped around it, and with connecting means applied to opposite edges of the body, which interact when in use to interconnect the opposite edges, creating a tube-like body having an insertion side for the foot and an opposite foot section, whereby each connecting means contains magnets which are attracted by corresponding magnets in the other connecting means. The aid according to the invention has appeared to be more convenient in use than the known aid.

In principle the magnets may be attached in each manner in, on or at the aid. In a preferred embodiment of the invention an aid is provided wherein the connecting means comprise bands, strips or pockets made from a flexible smooth material, in which the magnets are accommodated, and wherein more preferably the side of the bands, strips or pockets to be coupled has a rougher surface structure than the side not to be coupled. The magnets may for example be placed in separate pockets which subsequently are stitched in a row along the side edges. It is also possible according to the invention that the connecting means comprise bands made from a flexible smooth material, in which the magnets are accommodated. Such a band, strip or ribbon of material may contain a number of 'pockets', if required, in which the magnets may be placed. This band of material is then attached with the magnets along the side edges, for example by stitching.

In another aspect of the invention an aid is provided, wherein at least one of the connecting means comprises a band of magnetic material which extends along at least a part of the length of the edges of the body.

In another preferred embodiment of the aid according to the invention, at least one of the connecting means comprises a series of magnets arranged next to each other, which series extends along at least a part of the length of the edges of the body.

The number of magnets may be selected within wide limits. In a preferred embodiment there are three to five magnets in each side edge. In priciple also the shape of the magnets may be selected freely, although preferably round magnets are being applied.

The dimensions of the magnets may be chosen within wide limits. Particularly suitable dimensions of the magnets are lying between diameters of 0.5 to 1.5 cm, a thickness between 0.5 and 1.5 mm and a weight between 0.5 and 1 gram. The dimensions of the 'pockets' in which the magnets are being placed are adapted to the dimensions of the magnets, but have typical dimensions of 3.7 by 3.0 cm. A suitable gap between the 'pockets' at a side edge is between about 3 and 10 cm, preferably between 4 and 5 cm. The gap between two successive magnets is preferably between 6 and 12 cm, and more preferably between 8 and 9 cm. It is advantageous to choose the dimensions of the 'pockets' to such an extent that they are on each side at the most 2 mm larger than the dimension of a magnet accommodated in it, or in total 4 mm at the most. Such a preferred embodiment ensures that the magnets substantially maintain their position and may not easily be disposed.

The magnetic force of the magnets may be adjusted within wide limits, whereby on the one hand a sufficient coupling has to be realised and on the other hand should be avoided that the magnets attract each other too quickly with a too large force, which seriously may harm the user friendliness. Moreover it is convenient when the magnets are able to be disconnected by a user with a minimum strength.

If required the magnetic force of the magnets may be the same, for example since such an embodiment is a simple one. In a preferred embodiment wherein a series of magnets is applied, however, the magnetic force of the magnet which is closest to the insertion side of the body is larger than the magnetic force of the magnets which are further away from the insertion side. Such an aid appears to be easier in use.

Furthermore it is advantageous to characterize the aid according to the invention in that the magnetic force of the band of magnetic material and/or of the series of magnets decreases from the insertion side of the body towards the foot section of the same. This measure appears to further increase the user friendliness of the aid.

In an embodiment the aid according to the invention comprises removal means in the form of a band of material which is attached to the body at the level of the foot section and extends in the direction of and beyond the insertion side of the body. Preferably the removal means in addition are provided with at least one magnet which may be coupled to a magnet of the body. In this way the removal means is brought into a fixed position relative to the aid (and the leg of a user), which improves the user friendliness. It is also possible to apply another temporary connecting method instead of the magnet, possibly in combination with the magnet. A temporary connecting method may for example comprise a Velcro fastener.

In another aspect of the invention an aid is presented, wherein the foot section of the body is provided with a toe connecting piece which is foldable to the body, made from a smooth material whereby the foot section of the body which is tube-like in the coupled state may be connected. Preferably the toe connecting piece contains at least one magnet which may be coupled to at least one magnet of the body, particularly of the connecting means applied to the side bands. Here it is also possible to apply another temporary connecting method instead of the magnet, possibly in combination with the magnet. A temporary connecting method may for example comprise a Velcro fastener.

The invention will now be explained in greater detail. Although the aid predominantly has been developed for putting on elastic stockings and will be explained in greater detail based upon this example, it is stressed that the aid advantageously may also be applied for putting on prostheses, liners for prostheses, sport protection means, socks, shoes, skiing shoes, riding boots and wetsuits, without otherwise considering this list as limiting.

BRIEF DESCRIPTION OF THE DRAWINGS

The above and other aspects, features and advantages of the present invention will be elucidated by the disclosure hereinafter of a preferred embodiment of a pull-on aid according to the invention, with reference to the drawings, in which.

DETAILED DESCRIPTION OF THE PREFERRED EMBODIMENT(S)

Figure 1:
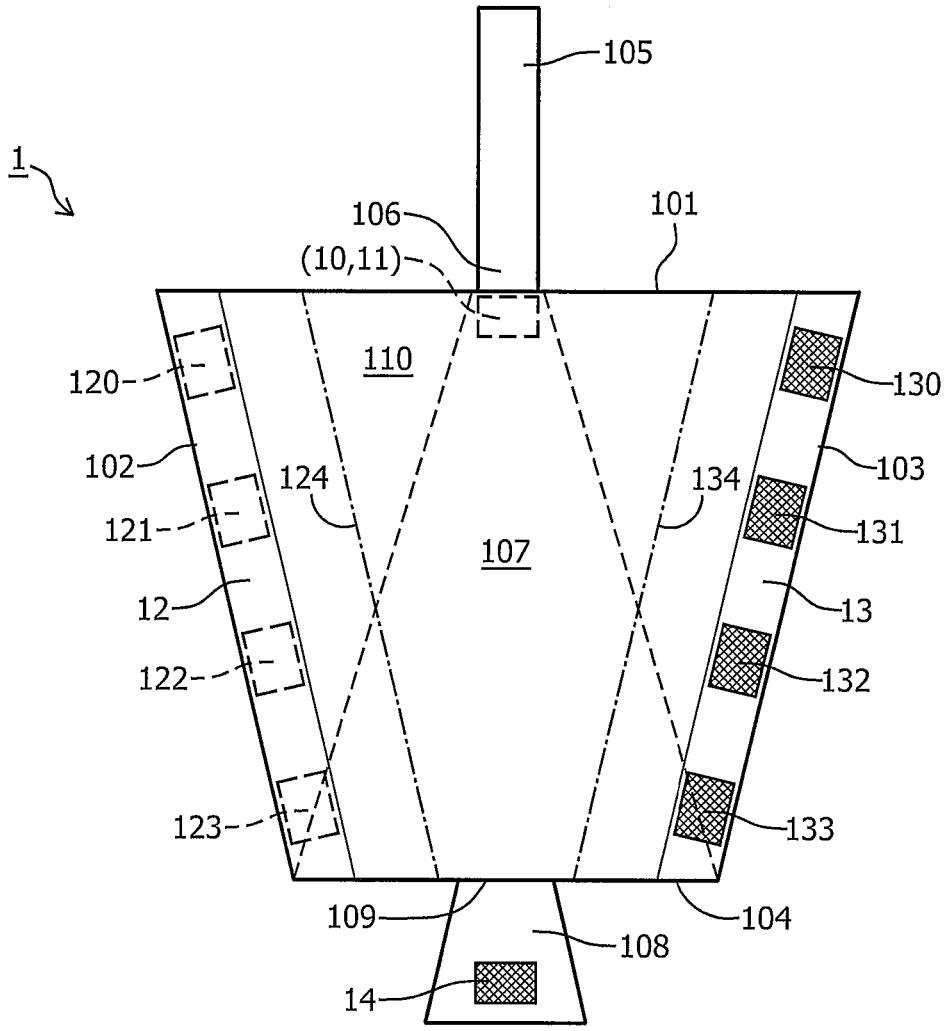
FIG. 1 shows a front view of an aid according to the invention in unfolded state, with the exception of the engagement member.

With reference to FIG. 1 an embodiment of an aid 1 according to the invention is shown. This aid 1 comprises substantially a single sheet 110 generally having in its unfolded state the shape of a parallelogram with possibly oblique upper edge 101. The single sheet 110 is manufactured from a material with a low coefficient of friction. An example of such a material is a plastic nylon cloth, which is provided with a coating having a low friction. Such a material is known per se and commercially available.

The aid 1 has an upper edge 101, and two substantially straight side edges 102 and 103 which meet each other at a foot section or top 104. At the top 104 an engagement member (105, 107) is attached, by which a user may grasp the top 104 and may exert a tensile strength. In an embodiment which is preferred due to simplicity, the engagement member (105, 107) comprises a pulling strip (105) which is attached to a folded back section 107 of the sheet 110. In an embodiment the section 107 is formed by folding back the sheet 110 at the top 104 along a certain length, in such a way that an end 106 of the sheet 110 projects further than the upper edge 101. In another embodiment the section is formed by a separate piece of cloth, which cloth may differ from the cloth applied in sheet 110, whereby the section 107 is attached at the lower edge 104, for example by a stitch connection. In the embodiment shown in FIG. 1 the folded back section 107 of the engagement member is at the back side of the body 110. According to the invention the folded back section 107 near the upper edge 101 is provided with a magnet 10 which may interact with a magnet 11 which is arranged in a corresponding position in, on or under the sheet 110. In FIG. 1 the magnet 10 is not visible since it is at the other (non-visible) side of the section 107. Magnet 11 is not visible since it is hidden from view by the section 107. By placing magnets (10, 11) in the vicinity of each other they will be mutually attracted, resulting in a coupling whereby the engagement member (105, 107) is brought into a fixed position relative to the body 110. Here the strength of the magnets preferably is chosen to such an extent that a coupling is produced when the magnets (10, 11) are brought within a distance of a few cm from each other. This considerably increases the user friendliness of the aid. In the embodiment shown in FIG. 1 the side edges of the folded back section 107 tapers upwards, but it is also possible that these side edges are running parallel to each other.

Starting from the upper edge 101 along a section of the side edges 102 and 103 continuous connecting bands 12 and 13 are attached. These continuous connecting bands 12 and 13 made from a flexible smooth material are adapted to be positively engaged with each other along their full length by providing them with a number of magnets. In another embodiment the connecting bands (12, 13) comprise a band of magnetic material which extends along at least a part of the length of the side edges (102, 103) of the body 110.

Each of the connecting bands (12, 13) in the embodiment shown comprises a series of magnets (120, 121, 122, 123) and (130, 131, 132, 133), respectively, arranged next to each other, which series extend along at least a part of the length of the side edges (12, 13) of the body (110). Preferably the magnetic force of the magnets (120, 130) which are closest to the insertion side 140 (see FIG. 4) is larger than the magnetic force of the magnets (121, 131), (122, 132) and (123, 133) which are further away from the insertion side 140. In another preferred embodiment the magnetic force of the magnets decreases from the insertion side or upper edge 101 of the body 110 to its foot section or lower edge 104. Thus in this preferred embodiment the magnetic force of the magnets (120, 130) will be larger than the magnetic force of the magnets (121, 131), which in turn is larger than the magnetic force of the magnets (122, 132).

In the view shown in FIG. 1 the side of the bands (12, 13) to be coupled has a rougher surface structure than the side not to be coupled, for example by applying in the side to be coupled a coarser fabric. This ensures apart from the magnetic coupling a mechanical coupling, since a higher friction arises on the contact surfaces. In FIG. 1 the rougher back side of band 13 is visible, where the rougher side of band 12 is hidden from view and only the smooth side not to be coupled is visible. The rougher surface may extend along the entire length of the bands (12, 13), but may be limited to discrete areas where the magnets have been sewed in, as shown in FIG. 1.

The length of the connecting bands 12 and 13 may be chosen arbitrarily, but typically it is almost equal to the total length of the side edges 102 and 103, considered from the base 101 to the foot section 104.

An important advantage of the aid based on a single sheet is that it requires a relatively low amount of material, and that for manufacturing a relatively low amount of operations are needed. However, it is also possible that the aid 1 comprises two sheets of a smooth material, which are placed on top of each other. The sheets are sewed together along the full length of their side edges and the lower edge near the foot section. The only edge section where the sheets are not sewed together is the upper edge, defining thus a mouth for a space between the sheets. However, it is also possible to attach the sheets to each other solely along the upper edge. In order for the bands with magnets to be kept clear at the side edges, a second sheet preferably is smaller than a first sheet and the second sheet thus extends to the band, strips or ribbons of material arranged to the side edges. In an embodiment with two sheets the pulling member will usually be between the two sheets, which is stitched to the foot section at the lower edge of the aid. Here the length of that pulling member is so large that it protrudes outside the sheets with the other end through the mouth.

Figure 3:
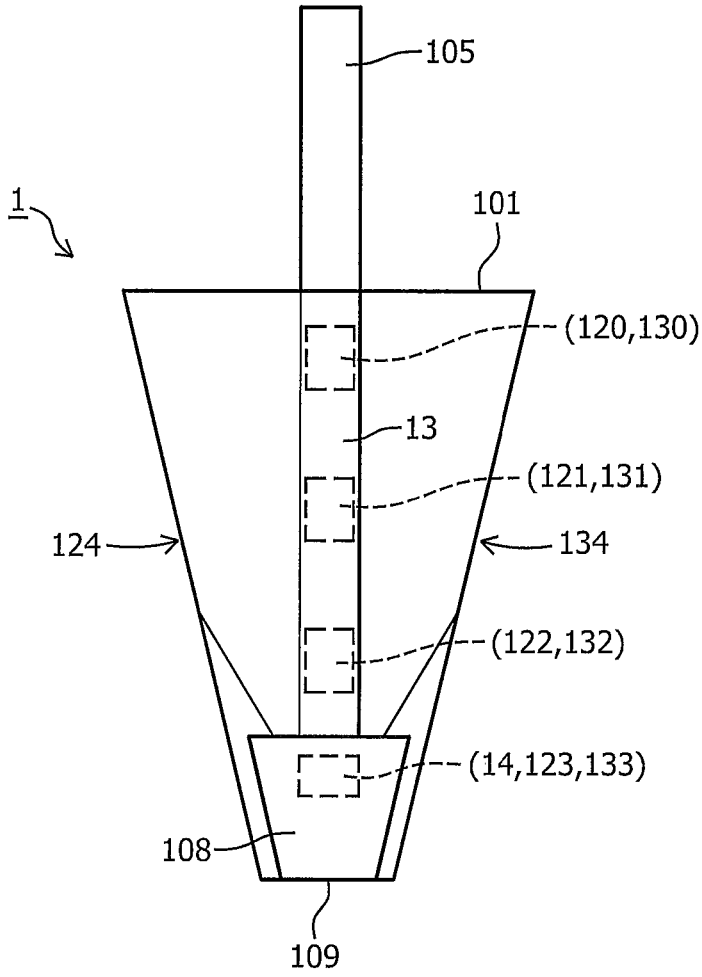
FIG. 3 shows a front view of the aid according to the invention shown in FIG. 1 in a fully folded state (an operational state); and finally

The embodiment of the aid according to the invention shown in the figures further comprises a foot section 104 of the body 110 that is provided with a toe connecting piece 108 foldable to the body 110 and made from a smooth material, preferably the same material from which the body 110 is manufactured. By means of the toe connecting piece 108 the foot section 104 of the body 110, which is tube-like in the coupled state, may be connected whereby the aid can be fixed around the foot in a better way. The toe connecting piece 108 according to the invention is also provided with at least one magnet 14 which may be coupled to at least one corresponding magnet (123 and/or 133) of one of the connecting bands (12 and/or 13). The coupled state of the toe connecting piece 108 is shown in FIG. 3. As mentioned earlier it is possible to apply another temporary connecting method instead of the magnet, possibly in combination with the magnet. A temporary connecting method may for example comprise a Velcro fastener (not shown).

Figure 2:
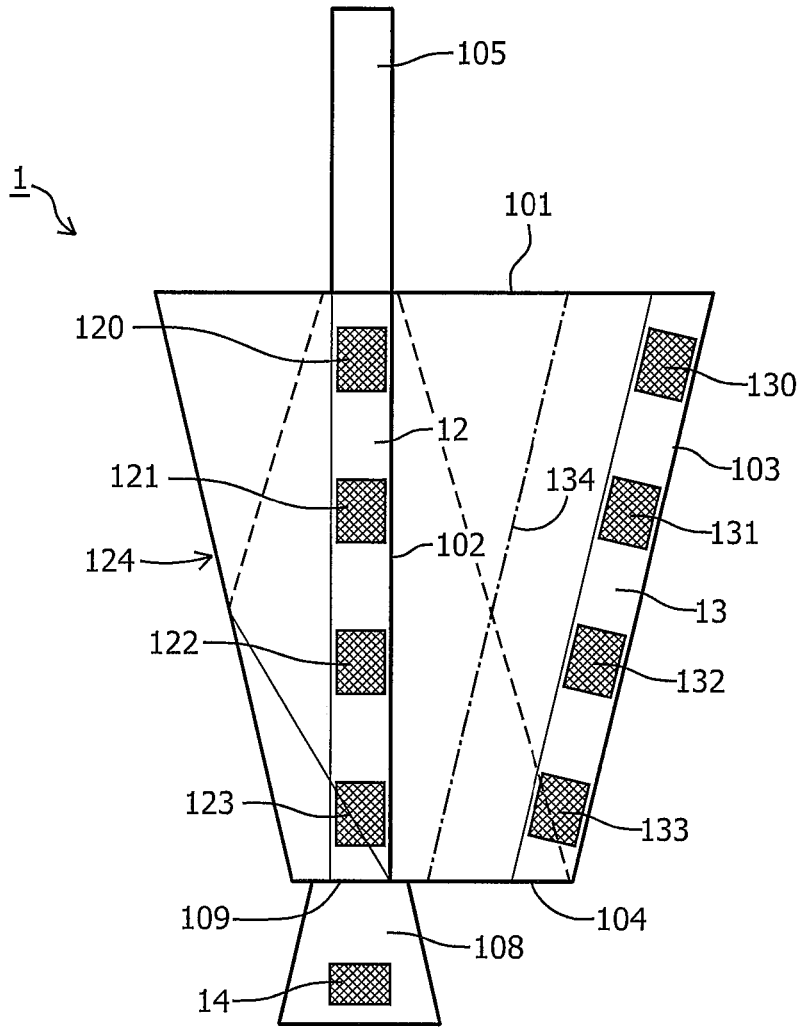
FIG. 2 shows a front view of the aid according to the invention shown in FIG. 1 in a partly folded state.

Now with reference to FIGS. 2 to 4 the effect of the aid 1 according to the present invention will be discussed.

In a first step the user folds the connecting bands 12 and 13 towards each other in the direction of the side faced away from the folded back section 107. As shown in FIG. 2 the connecting band 12 thus is brought around a folding seam 124 towards the body 110. Subsequently the connecting band 13 is brought in the same way around a folding seam 134 towards the body 110, until the mutual distance between the connecting bands (12, 13) has become so small that the connecting bands 12 and 13 automatically are attached to each other, at least temporarily, by mutual attraction of the magnets ((120, 121, 122, 123) and (130, 131, 132, 133). Subsequently the toe connecting piece 108 is also folded back by the user around a folding seam 109 towards the body 110, until the mutual distance between the magnet 14 of the toe connecting piece 108 and at least one corresponding magnet (123 and/or 133) of one of the connecting bands (12 and/or 13) has become so small that the toe connecting piece 108 automatically is attached to the body 110, at least temporarily, by mutual attraction of the magnets 14 and 123 and/or 133.

Figure 4:
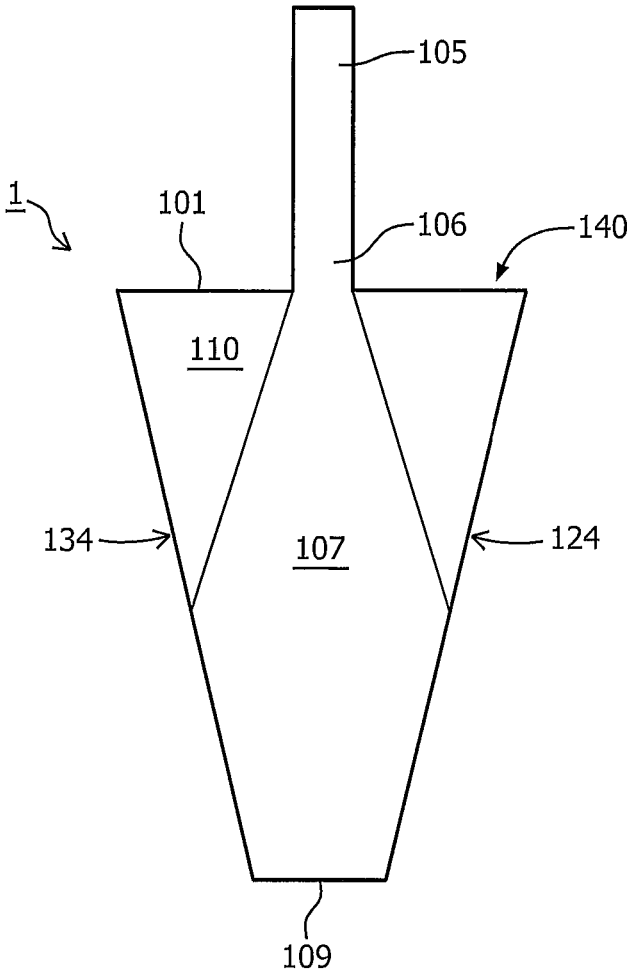
FIG. 4 shows a back view of the aid according to the invention shown in FIG. 1 in a fully folded state (an operational state).

As illustrated in FIG. 4 the aid 1 now has the shape of a tapered tube with an insertion mouth 140 and a foot end formed by folding seam 109 having a smaller cross-section, whereby the folded back section 107 of the aid 1 (and thus the removal means (105, 107)) is at the outside of that tube (FIG. 4 shows the aid 1 at the back side).

Subsequently the user put his foot into the insertion mouth 140, to the foot end formed by folding seam 109, whereby the aid 1 behaves as a widely fitting smooth sock. Due to the positive attachment of the connecting bands 12 and 13 to each other along their entire length, there is no danger that the aid 1 becomes ineffective, since the connecting bands 12 and 13 nowhere or hardly will separate from each other. The user subsequently pulls on a support stocking over the smooth sock, which will occur rather easily since the support stocking thereby will slide over the smooth material of the sock almost without friction.

When the support stocking has been pulled on sufficiently far, the aid 1 may be removed. Contrary to the known aid, whereby to this end firstly the coupling of the connecting bands has to be cancelled, the user pulls the pulling strip 105 whereby the aid 1 is pulled away between the foot and the stocking. Here the coupling between the connecting bands (12, 13) may be eliminated automatically, since the indeed small forces appear to be sufficient to overcome the magnetic force between the corresponding series of magnets (120, 121, 122, 123) and (130, 131, 132, 133). During removal there is hardly any friction, since the smooth removal means (105, 107) is attached to the foot section 104 to the body 110 and therefore will slide upwards during pulling over the smooth body 110. Because of this double layer only a small amount of friction is experienced. Once the removal means (105, 107) has been pulled up sufficiently far, the moving part of the sheet 110 of the aid 1 will make contact with the stocking with one surface, whereby a low amount of friction is experienced as well. In an embodiment in which the sheet 110 is double walled, the moving part of the sheet 110 will be in contact with the other surface with the stationary part of itself: this mutually sliding contact of two layers of the smooth material is causing almost no friction. The part of the sheet 110 which is in contact with the foot, which contact in principle could cause a relatively large frictional force, remains stationary, until that part is reached by folding back the moving part of the sheet 110 over itself and away from the foot. Thus the sheet 110 is so to speak stripped off the foot from under the stocking.

A further important advantage of the aid 1 according to the present invention is that after being removed from the foot it is ready for further use in a simpler way and in less steps than with the known aid.

It will be apparent for a skilled person that it is possible to change or to modify the displayed embodiment of the device according to the invention within the scope of the invention as defined by the appended claims.

The invention claimed is:

1. An aid for putting on (in particular) an elastic stocking, comprising a substantially flat and flexible sheet body manufactured from a smooth material, which is provided with removal means to remove the aid between a foot and a stocking wrapped around it, and with connecting means arranged on opposite edges of the body, which interact when in use to interconnect the opposite edges, resulting in a tube-like body with an insertion side for the foot and an opposite foot section, whereby the connecting means comprises magnets which are attracted by corresponding magnets in the other connecting means, whereby the body comprises a single sheet of a smooth material having a substantially tapered shape from the insertion side to the foot section, whereby the connecting means are arranged on the opposite side edges of the body, whereby the foot section of the body is provided with a toe connecting piece which is foldable to the body and made from a smooth material, and whereby the foot section of the body, which is tube-like in the coupled state, may be closed.

2. The aid according to claim 1, whereby the connecting means comprise bands, strips or pockets made from a flexible smooth material, in which the magnets are accommodated, and the side of the bands, strips or pockets to be coupled has a rougher surface structure than the side not to be coupled.

3. The aid according to claim 1, whereby at least one of the connecting means comprises a band of magnetic material which extends along at least a part of the length of the edges of the body.

4. The aid according to claim 3, whereby the magnetic force of the band of magnetic material decreases from the insertion side of the body to its foot section.

5. The aid according to claim 1, whereby at least one of the connecting means comprises a series of magnets arranged next to each other, which series extends along at least a part of the length of the edges of the body.

6. The aid according to claim 5, whereby the magnetic force of the series of magnets decreases from the insertion side of the body to its foot section.

7. The aid according to claim 1, whereby a series of magnets is applied and whereby the magnetic force of the magnet which is closest to the insertion side of the body is larger than the magnetic force of the magnets which are further away from the insertion side.

8. The aid according to claim 1, whereby the removal means comprise a band of material which is attached to the body at the level of the foot section and extends in the direction of and beyond the insertion side of the body.

9. The aid according to claim 1, whereby the removal means are provided with at least one magnet which may be coupled to a magnet of the body.

10. The aid according to claim 1, whereby the toe connecting piece comprises at least one magnet which may be coupled to at least one magnet of the body.

11. The aid according to claim 1, whereby the aid comprises two sheets of a smooth material, which are placed on top of each other, whereby the sheets are sewed together at least at their upper edge.

12. The aid according to claim 1, whereby the aid comprises two sheets of a smooth material, which are placed on top of each other, whereby the sheets are sewed together along at least a section of their side edges and the lower edge near the foot section.

* * * * *